United States Patent [19]

Stachurski et al.

[11] 4,422,920

[45] Dec. 27, 1983

[54] HYDROGEN CATHODE

[75] Inventors: John Z. O. Stachurski, Amherst; Gerald F. Pokrzyk, Lewiston, both of N.Y.

[73] Assignee: Occidental Chemical Corporation, Niagara Falls, N.Y.

[21] Appl. No.: 284,879

[22] Filed: Jul. 20, 1981

[51] Int. Cl.[3] ..... C25B 11/04

[52] U.S. Cl. ..... 204/290 R; 204/43 T; 204/293

[58] Field of Search ..... 204/290 R, 293, 43 T, 204/290 F

[56] References Cited

U.S. PATENT DOCUMENTS

| | | | |
|---|---|---|---|
| 2,080,483 | 5/1937 | Hull | 204/43 Z X |
| 2,080,520 | 5/1937 | Westbrook | 204/293 X |
| 2,844,530 | 7/1958 | Wesley et al. | 204/43 T X |
| 4,033,837 | 7/1977 | Kuo et al. | 204/98 |
| 4,171,247 | 10/1979 | Harang et al. | 204/34 |
| 4,190,514 | 2/1980 | Matsuura et al. | 204/242 |
| 4,221,643 | 9/1980 | Miles et al. | 204/98 |

*Primary Examiner*—F. Edmundson

*Attorney, Agent, or Firm*—James F. Tao; William G. Gosz

[57] ABSTRACT

A cathode for use in electrolytic processes and a process for preparing such cathodes is described. The cathode comprises a cathodically active surface layer applied to a suitable substrate material. The surface layer comprises a codeposit of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides and combinations thereof. The surface layer is applied from an electroplating solution containing a soluble sulfur-containing compound, such as an alkali metal thiocyanate or thiourea.

7 Claims, No Drawings

HYDROGEN CATHODE

BACKGROUND OF THE INVENTION

The present invention relates to improved cathodes for use in electrolytic cells. The cathodes of this invention exhibit low hydrogen overvoltage, improved bonding of the surface layer to the substrate and increased stability under normal cell operating conditions. The cathodes of the present invention are particularly useful in the electrolysis of aqueous solution of alkali metal halides to produce alkali metal hydroxides and halogens, or in the electrolysis of aqueous solutions of alkali metal halides to produce alkali metal halates, or in water electrolysis to produce hydrogen.

In an electrochemical cell, large quantities of electricity are consumed to produce alkali metal hydroxides, halogens, hydrogen, and alkali metal halates in electrochemical processes familiar to those skilled in the art. With increased cost of energy and fuel, the savings of electricity, even in relatively minor amounts, is of great economic advantage to the commercial operator of the cell. Therefore, the ability to effect savings in electricity through cell operation, cell design, or improvement in components, such as anodes and cathodes, is of increasing significance.

In such electrolytic processes, hydrogen is evolved at the cathode, and the overall reaction may be theoretically represented as:

$$2H_2O+2e^- \rightarrow H_2+2OH^- \quad (1)$$

However, the cathode reaction actually produces monoatomic hydrogen on the cathode surface, and consecutive stages of reaction (1) can be represented as follows:

$$H_2O+e^- \rightarrow H+OH^-$$

$$2H \rightarrow H_2 \quad (2)$$

or as:

$$H_2O+e^- \rightarrow H+OH^-$$

$$H+H_2O+e^- \rightarrow H_2+OH^- \quad (3)$$

The monoatomic hydrogen generated as shown in reactions (2) or (3) is adsorbed on the surface of the cathode and desorbed as hydrogen gas.

The voltage or potential that is required in the operation of an electrolytic cell includes the total of the decomposition voltage of the compound being electrolyzed, the voltage required to overcome the resistance of the electrolyte, and the voltage required to overcome the resistance of the electrical connections within the cell. In addition, a potential, known as "overvoltage" is also required. The cathode overvoltage is the difference between the thermodynamic potential of the hydrogen electrode (at equilibrium) and the potential of an electrode on which hydrogen is evolved due to an impressed electric current. The cathode overvoltage is related to such factors as the mechanism of hydrogen evolution and desorption, the current density, the temperature and composition of the electrolyte, the cathode material and the surface area of the cathode.

In recent years, increasing attention has been directed toward improving the hydrogen overvoltage characteristics of electrolytic cell cathodes. In addition to having a reduced hydrogen overvoltage, a cathode should also be constructed from materials that are inexpensive, easy to fabricate, mechanically strong, and capable of withstanding the environmental conditions of the electrolytic cell. Iron or steel fulfills many of these requirements, and has been the traditional material used commercially for cathode fabrication in the chlor-alkali industry. When a chlor-alkali cell is by-passed, or in an open circuit condition, the iron or steel cathodes become prone to electrolytic attack and their useful life is thereby significantly decreased.

Steel cathodes generally exhibit a cathode overvoltage in the range of from about 300 to about 500 millivolts under typical cell operating conditions, for example, at a temperature of about 100° C. and a current density of between about 100 and about 200 milliamperes per square centimeter. Efforts to decrease the hydrogen overvoltage of such cathodes have generally focused on improving the catalytic effect of the surface material or providing a larger effective surface area. In practice, these efforts have frequently been frustrated by cathodes or cathode coatings which have been found to be either too expensive or which have only a limited useful life in commercial operation.

Various coatings have been suggested to improve the hydrogen overvoltage characteristics of electrolytic cell cathodes in an economically viable manner. A significant number of the prior art coatings have included nickel, or mixtures, alloys or intermetallic compounds of nickel with various other metals. Frequently, when nickel is employed in admixture with another metal or compound, the second metal or compound can be leached or extracted in a solution of, for example, sodium hydroxide, to provide a high surface area coatings, such as Raney nickel coatings.

Representative coatings of the prior art are disclosed in U.S. Pat. No. 3,291,714, issued Dec. 13, 1966, and U.S. Pat. No. 3,350,294, issued Oct. 31, 1967. These patents disclose inter alia cathode coatings comprising alloys of nickel-molybdenum or nickel-molybdenum-tungsten electroplated on iron or steel substrates. The electro-deposition of nickel-molybdenum alloys utilizing a pyrophosphate bath is also discussed by Havey, Krohn, and Hanneken in "The Electrodeposition of Nickel-Molybdenum Alloys", *Journal of the Electrochemical Society*, Vol. 110, page 362, (1963).

Other attempts have been made in the prior art to produce coatings of this general variety which offer an acceptable compromise between coating life and low overvoltage characteristics. U.S. Pat. No. 4,105,532, issued Aug. 8, 1978, and U.S. Pat. No. 4,152,240, issued May 1, 1979, are representative of these attempts disclosing, respectively, alloys of nickel-molybdenum-vanadium and nickel-molybdenum using specially selected substrate and intermediate coatings of copper and/or dendritic copper. Similar coatings are also disclosed in U.S. Pat. Nos. 4,033,837 and 3,291,714.

The surface treatment of a Raney nickel electrode with a cadmium nitrate solution for the purpose of reducing hydrogen overvoltage has been investigated by Korovin, Kozlowa and Savel'eva in "Effect of the Treatment of Surface Raney Nickel with Cadmium Nitrate on the Cathodic Evolution of Hydrogen", *Soviet Electrochemistry*, Vol. 14, page 1266 (1978). Although the initial results of such a coating exhibit a good reduction in hydrogen overvoltage, it has been found that the overvoltage increases rapidly to the original level after a short period of operation, i.e. about 2 hours.

U.S. Pat. No. 4,190,516, issued Feb. 26, 1980, discloses an electrolytic cell cathode having low hydrogen overvoltage and high durability. The cathode consists essentially of a base material, i.e. copper, iron or nickel, having a coating of at least one metal of Group VIII of the periodic table. The coating is deposited on the base material from a solution or suspension of a sulfur-containing compound of the Group VIII metal such as nickel thiocyanate. The cathode is then sintered in an electroless process to convert the coating predominately to the Group VIII metal while retaining at least 3% sulfur. Below a sulfur content of 3% the hydrogen overvoltage of the resulting cathode coating is disclosed as being too high to be suitable for use in electrolytic applications.

U.S. Pat. No. 4,251,478, issued Feb. 17, 1981, discloses low overvoltage hydrogen cathodes comprising an electroconductive substrate material, an intermediate imporous nickel layer, and a porous surface comprising a major portion of nickel and a transition metal such as molybdenum. The porous surface layer can also include a leachable material which is codeposited along with the nickel and transition metal. The leachable materials, which include aluminum, cadmium and copper, are removed from the surface layer with sodium hydroxide to increase the surface area, leaving only trace amounts remaining after leaching.

Copending application Ser. No. 104,235, filed Dec. 17, 1979, addresses the problem of low hydrogen overvoltage by disclosing a novel cathode having an active surface layer comprising, as a preferred embodiment thereof, a codeposit of nickel, molybdenum or an oxide thereof, and cadmium. The application also describes various intermediate protective layers, which can be suitably interposed between the substrate and active surface layer to protect the substrate from the corrosive effects of the electrolytic cell environment. Such layers include nickel and various alloys or mixtures of nickel with other metals.

Although many of the cathodes disclosed in the prior art exhibit satisfactory adherence of the coating to the substrate under normal conditions, there exists a continuing need to maximize the useful life of the cathode and to improve the stability of the coating under the conditions prevailing during the commercial operation of an electrolytic cell. Many of the prior art attempts at reducing the hydrogen overvoltage of the cathode, while initially successful, have ultimately failed due to rapid deterioration of the coating in the caustic environment, causing the coating to separate from the substrate material.

BRIEF DESCRIPTION OF THE INVENTION

In accordance with the present invention, there is provided a cathode for use in electrolytic proceses, and a method for producing such cathodes. The cathodes of this invention are fabricated by applying a surface coating to at least a portion of a suitable substrate material. In general, the substrate materials are known in the art and comprise, for example, nickel, titanium, or a ferrous metal, such as iron or steel. The surface layer is formed by codepositing onto the substrate a mixture of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides, and combinations thereof. The surface layer is applied to the substrate from an electroplating bath or solution containing a soluble sulfur-containing compound, such as an alkali metal thiocyanate or thiourea. At least a portion of the second metal or metal oxide is subsequently removed from the coating, suitably by leaching using an alkaline solution, such as an aqueous solution of an alkali metal hydroxide. Leaching can be performed prior to placing the cathode in operation in an electrolytic cell, or during actual operation in the cell by virtue of the presence of an alkali metal hydroxide in the electrolyte.

DETAILED DESCRIPTION OF THE INVENTION

The present cathode comprises a substrate material and a surface layer. The substrate may be selected from any suitable material having the required electrical and mechanical properties, and the chemical resistance to the particular electrolytic solution in which it is to be used. Generally, conductive metals or alloys are useful, such as ferrous metals (iron or steel), nickel, copper, or valve metals such as tungsten, titanium, tantalum, niobium, vanadium, or alloys of these metals, such as titanium/palladium alloy containing 0.2% palladium. Because of their mechanical properties, ease of fabrication, and cost, ferrous metals, such as iron or steel, are commonly used in chlor alkali cells. However, in chlorate cells where corrosion of the substrate material is a significant problem, titanium or titanium alloys are preferred.

The surface layer can then be applied directly to the substrate material from a suitable electroplating solution. Alternately, if a substrate material other than nickel is utilized, a Watts nickel layer can be applied to the substrate as an undercoating, and the intermediate binding layer can then be applied directly to the Watts nickel layer. The surface layer comprises a codeposit of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides, and combinations thereof. The electroplating solution contains a soluble sulfur-containing compound which serves to improve the deposition of the binding layer and also serves to improve the adhesion of the coating to the substrate. Suitable sulfur-containing compounds include alkali metal thiocyanates, such as potassium thiocyanate, and thiourea.

Prior to coating the substrate in the plating bath, the substrate is preferably cleaned to insure good adhesion of the binding layer. Techniques for such preparatory cleaning are conventional and well known in the art. For example, vapor degreasing or sand or grit blasting may be utilized, or the substrate may be etched in an acidic solution or cathodically cleaned in a caustic solution.

After cleaning, the substrate can then be immersed in a plating bath to simultaneously codeposit the first metal and the second metal or metal oxide. The basic electroplating technique which can be utilized in this invention is known in the prior art. For example, U.S. Pat. No. 4,105,532, issued Aug. 8, 1978,and Havey, Krohn, and Hannekin in "The Electrodeposition of Nickel-Molybdenum Alloys", *Journal of the Electrochemical Society*, Vol. 110, page 362 (1963), describe, respectively, typical sulfate and pyrophosphate plating solutions. By way of illustration, a suitable plating bath composition for codepositing a surface layer of nickel and molybdenum or molybdenum oxide, the preferred first and second metals according to the present invention, is as follows:

TABLE I

| | |
|---|---|
| $Na_2MoO_4.2H_2O$ | 0.02M |
| $NiCl_2.6H_2O$ | 0.04M |
| $Na_2P_2O_7.10H_2O$ | 0.130M |
| $NaHCO_3$ | 0.893M |
| $ZnCl_2$ | $3 \times 10^{-4}$M |
| Hydrazine Sulfate | 0.0254M |
| $CdNO_3.4H_2O$ | $3 \times 10^{-4}$M |
| KSCN | $5.8 \times 10^{-4}$M |

The concentration of the potassium thiocyanate in the electroplating solution used for plating the binding layer can vary within wide limits, although a concentration of less than about 0.1 g./l. is generally preferred. Other sources of nickel and molybdenum, such as other soluble salts of these metals, as well as other sulfur-containing compounds, e.g. thiourea, can be utilized in place of the specific compounds listed above.

Preferably, the first and second metals for the surface layer are nickel and molybdenum, respectively, with the molybdenum being present in an amount of from about 0.5 to about 40 atomic percent.

Conditions for leaching the second metal from the surface coating and for heat treating cathode, as well as techniques for applying the coating, are more fully described in copending application Ser. No. 104,235, filed Dec. 17, 1979, the disclosure of which is incorporated herein by reference.

The term "codeposit", as used in the present specification and claims, embraces any of the various alloys, compounds and intermetallic phases of the particular metals or metal oxides, and does not imply any particular method or process of formulation.

The cathodes of the present invention have applications in many types of electrolytic cells and can function effectively in various electrolytes. Cathodes having an assortment of configurations and designs can be easily coated using the electroplating technique of this invention, as will be understood by those skilled in the art.

The following example further illustrates and describes the various aspects of the invention, but is not intended to limit it. Various modifications can be made in the invention without departing from the spirit and scope thereof, as will be readily appreciated by those skilled in the art. Such modifications and variations are considered to be within the purview and scope of the appended claims.

EXAMPLE

Two nickel cathode samples were sandblasted and degreased in trichlorethylene and plated in a two liter beaker containing 1500 milliliters of the plating solution of Table 1 above. A nickel anode was positioned midway between the two cathodes which were spaced 3½" apart. The plating procedure was conducted at a current density of 0.13 A/in.$^2$ for 5 minutes and was then increased to 0.65 A/in.$^2$ for an additional 30 minutes. The temperature of the plating bath was maintained in a range of between 16° C. and 21° C. using an ice water bath. The initial solution pH of 7.8 was increased to 8.0 during plating. After plating, the cathodes were rinsed with water and dryed with methanol and air. Both cathodes had a combined surface area of 13 in.$^2$ facing the anode.

A cathode prepared according to the procedure specified above was tested as a hydrogen cathode in a solution of 150 g./l. NaOH and 170 g./l. NaCl at 95° C. and a current density of 1.5 ASI, and compared with a cathode prepared using the same plating solution without the addition of $ZnCl_2$ and KSCN. The cathode of the present invention exhibited an increase in overvoltage of from 152 mv to 154 mv after 188 days of operation, while the cathode prepared for purposes of comparison exhibited an increase in overvoltage of from 106 mv to 201 mv after 164 days of operation.

What is claimed is:

1. A cathode for use in electrolytic processes comprising a substrate material and a surface layer applied to at least a part of the substrate comprising a codeposit of a first metal selected from the group consisting of iron, cobalt, nickel and mixtures thereof, and a second metal selected from the group consisting of molybdenum, manganese, titanium, tungsten, indium, chromium, and combinations thereof, said surface layer being applied from an electroplating solution containing said metals, an alkaline metal thiocyanate or thiourea and a minor amount of zinc ions.

2. The cathode of claim 1 wherein the substrate material is nickel.

3. The cathode of claim 1 wherein the substrate material is a ferrous metal.

4. The cathode of claim 3 wherein a nickel undercoating is applied between the surface layer and the substrate.

5. The cathode of claim 1 wherein the first metal is nickel and the second metal is molybdenum.

6. The cathode of claim 5 wherein the molybdenum is present in the range of from about 0.5 to about 40 atomic percent.

7. The cathode of claim 1 wherein the electroplating solution contains less than about 0.1 g./l. of alkali metal thiocyanate.

* * * * *